US006136105A

United States Patent [19]

Spencer

[11] Patent Number: 6,136,105

[45] Date of Patent: Oct. 24, 2000

[54] PROCESS FOR IMPARTING HIGH STRENGTH, DUCTILITY, AND TOUGHNESS TO TUNGSTEN HEAVY ALLOY (WHA) MATERIALS

[75] Inventor: William R. Spencer, Longwood, Fla.

[73] Assignee: Lockheed Martin Corporation, Bethesda, Md.

[21] Appl. No.: 09/096,579

[22] Filed: Jun. 12, 1998

[51] Int. Cl.[7] ..... B22F 1/00

[52] U.S. Cl. ..... 148/514; 148/668; 148/673; 419/28; 419/47

[58] Field of Search ..... 148/514, 668, 148/673; 419/28, 47

[56] References Cited

U.S. PATENT DOCUMENTS

| | | | |
|---|---|---|---|
| 3,888,636 | 6/1975 | Sezerzenie et al. | 29/182 |
| 4,762,559 | 8/1988 | Penrice et al. | 75/248 |
| 4,931,252 | 6/1990 | Bruisholz et al. | 419/23 |
| 4,990,195 | 2/1991 | Spencer et al. | 420/430 |
| 5,008,071 | 4/1991 | Spencer et al. | 419/28 |
| 5,145,512 | 9/1992 | Spencer et al. | 419/28 |
| 5,462,576 | 10/1995 | Stuitje et al. | 75/248 |
| 5,523,048 | 6/1996 | Stinson et al. | 419/28 |

OTHER PUBLICATIONS

Metals Handbook, Ninth Edition, vol. 14, "Forming and Forging", ASM International Handbook Committee, Apr., 1996.

*Primary Examiner*—George Wyszomierski
*Attorney, Agent, or Firm*—Burns, Doane, Swecker & Mathis, LLP

[57] ABSTRACT

A method of imparting high strength, high ductility, and high fracture toughness to a refractory metal alloy workpiece includes: (i) subjecting the workpiece to at least one pass that reduces the initial cross-sectional area of said workpiece, (ii) annealing the workpiece subsequent to the at least one pass, and (iii) subjecting the workpiece to a final working step comprising at least one pass conducted at a temperature between ambient and 300° C., the final working step further reducing the cross-sectional area of the workpiece such that the total reduction in the initial cross-sectional area of the workpiece is approximately 40%–75% and the final cold working is 0.30 to 0.75 of the total reduction in cross-sectional area. The resulting article has a tensile yield strength of approximately 170–200 Ksi, a tensile elongation of approximately 12%–17%, and a Charpy 10 mm Smooth Bar impact toughness of approximately 100 ft.-lb. to 240 ft.-lb.

17 Claims, No Drawings

PROCESS FOR IMPARTING HIGH STRENGTH, DUCTILITY, AND TOUGHNESS TO TUNGSTEN HEAVY ALLOY (WHA) MATERIALS

At least some aspects of this invention were made with Government support under contract no. F08630-96-C-0042. The Government may have certain rights in this invention.

FIELD OF THE INVENTION

The invention relates to a method of imparting high strength, high ductility and high toughness to an alloy, and the resulting article. In preferred embodiments, the method includes a plurality of working steps that effect a predetermined reduction in the cross-sectional area of a liquid phase sintered tungsten heavy alloy workpiece.

BACKGROUND OF THE INVENTION

It is known to plastically work refractory metal alloys to improve the strength thereof. Typically, these materials exhibit increased strength and increased hardness in proportion with increased reduction in cross-sectional area of the workpiece being worked.

Previously, certain refractory metal alloys, such as liquid-phase-sintered tungsten heavy alloys were mechanically worked in the range of 7% to 25% reduction in cross-sectional area in order to produce a high strength material. Working the material beyond about 25% using conventional techniques has been found to produce defects at the matrix/tungsten interface. Also, working the alloy in this manner results in a significant reduction in ductility and/or fracture toughness.

Often it is desirable to produce an alloy having a combination of properties, such as high ductility, high fracture toughness, as well as high strength. Previously, such a combination of properties could only be obtained by working the material to a total reduction in area on the order of about 95%, or greater. Applying this much work to the alloy workpiece is costly, time consuming, and makes it difficult, if not impossible, to produce certain larger, more complex shapes.

U.S. Pat. No. 4,990,195 to Spencer et al. discloses a process for producing solid-state sintered only tungsten heavy alloy articles that includes forming a bar from the tungsten heavy alloy material and working the bar to achieve a total reduction in area of at least 80%.

U.S. Pat. No. 4,762,559 to Penrice et al. discloses a high density tungsten-based alloy with a matrix of nickel-iron-cobalt and method for making the same which includes swaging a sintered compacted body to effect a total reduction in area of 5% to 40%, and typically 20% to 25%.

U.S. Pat. No. 5,523,048 to Stinson et al. discloses a method for producing high density refractory metal warhead liners that includes forming a near net-shaped blank from pure or solid-solution-alloy molybdenum or tungsten powder, and optionally subjecting this workpiece to a singular forging step. The amount of reduction in cross-sectional area effected by this forging step is not disclosed.

SUMMARY OF THE INVENTION

The method of the present invention produces an article possessing a beneficial combination of properties including high ductility, high fracture toughness, and high strength.

These and other beneficial results can be obtained by subjecting a refractory metal alloy to a process including: (i) subjecting the workpiece to a first cold or warm working step including at least one pass that reduces the initial cross-sectional area of said material, (ii) annealing the workpiece subsequent to the at least one pass, and (iii) subjecting the alloy to a final working step comprising at least one pass conducted at a temperature between ambient and 300° C., the final working step further reducing the cross-sectional area of the workpiece such that the overall total reduction in the initial cross-sectional area of the workpiece effected by all working steps is approximately 40%–75%.

The invention also encompasses the resulting article which possesses a tensile yield strength of approximately 170–200 Ksi, a tensile elongation of approximately 12%–17%, and a Charpy 10 mm Smooth Bar impact toughness of approximately 100 ft.-lb. to 240 ft. -lb.

DETAILED DESCRIPTION OF THE INVENTION

The method of imparting a material with high strength, high ductility, and high impact toughness according to the principles of the present invention generally includes a series of working and annealing steps that effect a total reduction in cross-sectional area on the order of 40% to 75%. This method can be applied to numerous alloy materials. However, in a preferred embodiment, excellent results can be obtained when the method is applied to a refractory metal alloy, such as a tungsten heavy alloy (WHA).

By way of example, a tungsten heavy alloy may have a composition comprising 80–90% W, with additions of Ni, Fe, and/or Co. One possible composition comprises 90 wt. % tungsten, 8 wt. % nickel, and 2 wt. % iron.

Such alloys can be produced by any number of suitable techniques, such as powder metallurgy techniques.

By way of example, the powdered components may be cold pressed to form any desirable solid or hollow shape such as a cylinder, cone-like, or ogive shape, or combination thereof. The cold-pressed body is then solid-state sintered to achieve approximately 95% density (with 5% porosity). Preferably, the body is then liquid phase sintered to further densify the compacted body. While not necessary to practice the present invention, a detailed description of these techniques can be found, for example, in U.S. Pat. No. 5,008,071 to Spencer et al. and U.S. Pat. No. 3,888,636 to Sczerzenie et al., the disclosures of which are incorporated herein by reference.

The consolidated, densified body forms a workpiece that is subsequently subjected to the forging/annealing procedure detailed below.

Optionally, the workpiece may be annealed subsequent to sintering in order to make the material more ducitle and easier to deform without fracture, thereby facilitating subsequent working.

In a preferred embodiment, the sintered workpiece has a tungsten grain size on the order of about 30 $\mu$m to 50 $\mu$m.

The workpiece is subjected to a first working step. In a preferred embodiment, the first working step may comprise one or more forging passes. Preferably, the one or more forging passes are either cold or warm forging passes. Cold forging is generally conducted at temperatures that range from ambient to approximately 300° C. Warm forging is generally conducted at temperatures that range from 650° C. to 9000° C. However, the one or more forging passes can also be conducted at temperatures that lie outside these preferred ranges.

Each pass of the first step preferably reduces the cross-sectional area of the workpiece by approximately 15–30%.

The percentage of reduction in cross-sectional area can be expressed as follows:

$$\frac{A_{n-1}-A_n}{A_{n-1}}\times 100 = \%\text{ reduction in cross-sectional area } (RIA)$$

Where A is the cross-sectional area of the workpiece, and n is the number of the particular pass. For example, for the first forging pass n=1, and n−1=0. Therefore the reduction in cross-sectional area effected by the first pass is expressed as:

$$\frac{A_0-A_1}{A_0}\times 100 = \%\text{ reduction in cross-sectional area effected by the first pass} = RIA_{fp} = 15\%\text{ to }30\%$$

Where $A_0$ is the initial cross-sectional area of the workpiece prior to working, and $A_1$ is the cross-sectional area of the workpiece and $RIA_{fp}$ is the reduction in area subsequent to the first pass.

In a preferred embodiment, if more than one pass is made, the amount of reduction in area effected by each pass can be approximately the same.

Any suitable technique and apparatus may be employed to reduce the cross-sectional area of the workpiece. For example, suitable techniques which are familiar to those of ordinary skill in the art include: Pilger (formerly known as Rockrite) forging, mandrel radial forging, mandrel swaging, forward extrusion, reverse extrusion/forging, rotary forging, roll-flow processing, roll-extrusion forging, rotary point tube spinning, and mandrel tube drawing. While not necessary for those of ordinary skill in the art to practice the invention, a more detailed description of these and other working techniques may be found in the "Metals Handbook, Ninth Edition"; published by ASM International; April 1996; volume 14, pages 16–18 and 159–188.

Subsequent to each pass in the first working step, the workpiece is preferably annealed in order to soften the material and thereby reduce the possibility of fracture as well as the amount of force necessary to reduce the cross-sectional area in subsequent passes. The parameters of this annealing step are chosen such that the tungsten grains do not recrystallize during annealing. Generally, lower annealing temperatures are used over longer periods of time subsequent to a high reduction in area effected by a cold pass. Conversely, higher annealing temperatures are used over shorter periods of time subsequent to a lower reduction in area effected by a hot pass. In a preferred embodiment, annealing can be carried out at temperatures ranging from approximately 900° C. to 1200° C., and over a period of time ranging from approximately 2 hours to 5 hours.

Next, a final working step is employed. In a preferred embodiment, the final working step includes a cold forging procedure conducted under temperatures ranging from ambient to approximately 300° C. The final working step may comprise a single cold pass or multiple cold passes. If multiple passes are performed, there is preferably no annealing between the passes.

The cumulative amount of reduction in cross-sectional area effected by the single or multiple passes of the final working step is preferably between approximately 20% and 55%. The percentage reduction in cross-sectional area effected by the final working step can be expressed as follows:

$$\frac{A_p-A_a}{A_p}\times 100 = \%\text{ reduction in cross-sectional area effected by the final working step} = RIA_{fw} = 20\%\text{ to }55\%$$

Where "$A_p$" is the cross-sectional area of the workpiece prior to the first pass of the final working step, "$A_a$" is the cross-sectional area of the workpiece after the final pass of the final working step.

In addition, the percentage of reduction in cross-sectional area effected by the final working step ($RIA_{fw}$) divided by the overall total reduction in cross-sectional area of the workpiece measured after the final pass is between 0.30 and 0.75.

The overall total reduction in cross-sectional area $$\frac{A_o-A_a}{A_o}\times 100 = \%\text{ overall total reduction in cross-sectional area} = RIA_{total}$$

wherein "$A_o$" is the cross-sectional area of the workpiece prior to the first pass of the first working step, and "$A_a$" is the cross-sectional area of the workpiece after the final pass of the final working step.

By subjecting the workpiece to one or more cold passes in the final working step, the elongation of the tungsten grains is increased and the worked microstructure of the tungsten and the matrix alloy due to the cold working pass(es) is substantially retained by the workpiece. These worked, elongated grains and the worked matrix impart substantial strength, elongation, and toughness to the workpiece.

As previously noted, the overall total amount of reduction in cross-sectional area of the workpiece effected by all working steps is on the order of 40% to 75%.

After the final working step, an optional aging treatment may be employed to further adjust the properties of the alloy by increasing the tensile yield strength, while decreasing the tensile elongation and decreasing the fracture toughness. In a preferred embodiment, the aging treatment is carried out at a temperature with the range of approximately 400° C. to 700° C. over a period of time on the order of 2 hours to 5 hours.

Therefore it has been discovered that by subjecting a workpiece to the above-described process steps, in which an overall total reduction in area on the order of 40% to 75% is effected, a product can be produced having an unexpected beneficial combination of high strength, high ductility, and high fracture toughness. For example, a heavy tungsten alloy worked by the above described method has a tensile yield strength of about 170 Ksi to about 200 Ksi, a tensile elongation of about 12% to about 17%, and a Charpy 10 mm smooth bar impact toughness of about 100 ft.-lb. to about 240 ft.-lb.

Since the method of the present invention is capable of imparting the above-described properties to the alloy by effecting a total reduction in cross-sectional area of approximately 40% to 75%, as compared to a total reduction in cross-sectional area on the order of 95% or more required by conventional methods, the method of the present invention makes it possible to form larger more complicated shapes having improved properties when compared to conventional processes. For example, the method of the present invention can be utilized to form large cylinder/ogive-shaped articles possessing high strength, high ductility, and high impact toughness.

Articles produced by the method of the present invention can be utilized in numerous applications where high strength, impact resistance, and the ability of the article to penetrate other objects are required. One such application is an cylinder/ogive-shaped warhead casing.

Although the present invention has been described by reference to particular embodiments, it is in no way limited thereby. To the contrary, modifications and variants will be apparent to those skilled in the art in the context of the following claims.

What is claimed is:

1. A method of imparting strength, ductility, and fracture toughness to a refractory metal alloy workpiece having an initial cross-sectional area comprising the steps of:

(i) subjecting said alloy workpiece to a first working step at a temperature between ambient and 300° C. comprising at least one pass that reduces said initial cross-sectional area of said workpiece;

(ii) annealing said workpiece subsequent to said at least one pass; and (iii) subjecting said workpiece to a final working step comprising at least one pass conducted at a temperature between ambient and 300° C., said final working step further reducing the cross-sectional area of said workpiece such that a total reduction in said initial cross-sectional area of said workpiece after said final working step is 40%–75%.

2. The method of claim 1, wherein at least one of said first and said final working steps includes at least one of forging and extrusion.

3. The method of claim 1, wherein the working of steps (i) and (iii) produces elongation of the alloy material in an axial direction.

4. The method of claim 1, wherein the reduction in area of steps (i) and (iii) is attained by a technique chosen from the group consisting of: Pilger forging, mandrel radial forging forward extrusion, reverse extrusion/forging, rotary forging, roll-flow processing, roll-extrusion forging, rotary point tube spinning, and mandrel tube drawing.

5. The method of claim 1, wherein multiple passes are conducted in step (i), each pass effecting a reduction in area that is approximately equal to the reduction in area produced by the previous pass; and each of said multiple passes effecting a reduction in area of 15%–30%.

6. The method of claim 1, wherein said annealing of step (ii) is conducted at a temperature of approximately 900° C. to 1200° C. for a period of approximately 2 to 5 hours.

7. The method of claim 1, wherein said final working step (iii) is completed in a single pass.

8. The method of claim 1, wherein said final working step (iii) includes multiple passes.

9. The method of claim 1, wherein the amount of reduction in cross-sectional area of said workpiece effected by said final working step (iii) is 20%–55%.

10. The method of claim 1, wherein the amount of reduction effected by the final working step (iii) divided by said total reduction in area equals 0.30–0.75.

11. The method of claim 1, subsequent to step (iii) further comprising the step of:

(iv) aging said workpiece at a temperature of approximately 400°–600° C. for approximately 2 to 5 hours.

12. The method of claim 1, wherein said alloy is a liquid phase sintered tungsten heavy alloy.

13. The method of claim 1, wherein said alloy is a liquid phase sintered tungsten heavy alloy that has been annealed.

14. The method of claim 13, wherein said heavy tungsten alloy comprises 80–90 wt. % tungsten and at least a second component chosen from the group consisting of: nickel, iron, cobalt, and any combination thereof.

15. A method of imparting strength, ductility, and fracture toughness to a refractory metal alloy workpiece having an initial cross-sectional area comprising the steps of:

(i) subjecting said alloy workpiece to a first working step at a temperature between about 650° C. to about 900° C. comprising at least one pass that reduces said initial cross-sectional area of said workpiece;

(ii) annealing said workpiece subsequent to said at least one pass;

(iii) subjecting said alloy workpiece to a second working step at a temperature of ambient to about 300° C. to further reduce the cross-sectional area of said workpiece;

(iv) annealing said workpiece subsequent to said second working step; and (v) subjecting said workpiece to a final working step at a temperature between ambient to about 300° C. to further reduce the cross-sectional area of said workpiece such that the total reduction in said initial cross-sectional area after said final working step is 40%–75%.

16. The method of claim 15, wherein the ratio of the reduction in cross-sectional area of the workpiece effected by said final working step to the total reduction in cross-sectional area of the workpiece equals 0.30–0.75.

17. A method of imparting strength, ductility, and fracture toughness to a refractory metal alloy workpiece having an initial cross-sectional area comprising the steps of:

(i) subjecting said alloy workpiece to a first working step comprising at least one pass that reduces said initial cross-sectional area of said workpiece;

(ii) annealing said workpiece subsequent to said at least one pass; and (iii) subjecting said alloy workpiece to a second working step at a temperature of ambient to about 300° C. to further reduce the cross-sectional area of said workpiece such that the ratio of the reduction in cross-sectional area of the workpiece effected by said second working step to the total reduction in cross-sectional area of the workpiece equals 0.50–0.75.

* * * * *